United States Patent [19]

Russell

[11] 4,329,822

[45] May 18, 1982

[54] FILLED POLYMERIC WALL FACING UNITS AND SYSTEMS

[75] Inventor: Alexander H. Russell, Owings Mills, Md.

[73] Assignee: The Burns and Russell Company, Baltimore, Md.

[21] Appl. No.: 160,474

[22] Filed: Jun. 18, 1980

[51] Int. Cl.[3] ..... E04C 1/00

[52] U.S. Cl. ..... 52/309.16; 52/309.17; 52/311; 52/422

[58] Field of Search ..... 52/309.17, 311, 314, 52/388, 389, 384, 386, 254, 422, 434, 390, 309.16

[56] References Cited

U.S. PATENT DOCUMENTS

| | | | |
|---|---|---|---|
| 658,387 | 9/1900 | Mitchell | 52/255 |
| 857,775 | 6/1907 | Walter | 52/254 X |
| 1,437,114 | 11/1922 | Maze | 52/254 X |
| 1,519,099 | 12/1924 | Ardell . | |
| 1,988,739 | 1/1935 | Jones | 52/257 X |
| 1,994,829 | 3/1935 | Nagin . | |
| 2,267,002 | 12/1941 | Turner . | |
| 2,669,114 | 2/1954 | Mills . | |
| 2,751,775 | 6/1956 | Sergovic . | |
| 2,850,890 | 9/1958 | Rubenstein . | |
| 2,951,001 | 8/1960 | Rubenstein . | |
| 3,001,330 | 9/1961 | Czapliche | 52/254 |
| 3,067,545 | 12/1962 | Gaines . | |
| 3,125,831 | 3/1964 | Marsch et al. | 52/384 X |
| 3,328,231 | 6/1967 | Sergoviz . | |
| 3,376,629 | 4/1968 | Baumann et al. | 52/309.17 |
| 3,390,505 | 7/1968 | Dockerty | 52/596 |
| 3,591,437 | 7/1971 | Schafer | 156/245 |
| 3,740,911 | 6/1973 | O'Leary | 52/388 |
| 4,031,289 | 6/1977 | Sergovic | 52/309.3 X |
| 4,185,423 | 1/1980 | Gutierrez | 52/79.9 |

*Primary Examiner*—Carl D. Friedman

*Attorney, Agent, or Firm*—Cushman, Darby & Cushman

[57] ABSTRACT

The present invention relates to filled polymeric wall facing units provided with at least one mortar tie-in member (e.g., a metal mesh lathing material) embedded in and protruding from the backing surface of these units. The tie-in member permits the unit to be mortared onto a base wall structure made of, e.g., masonry materials, wall board or steel panels. Particular wall facing units are panels and corner units. The present invention also relates to wall systems having corner facing units of the present invention.

19 Claims, 11 Drawing Figures

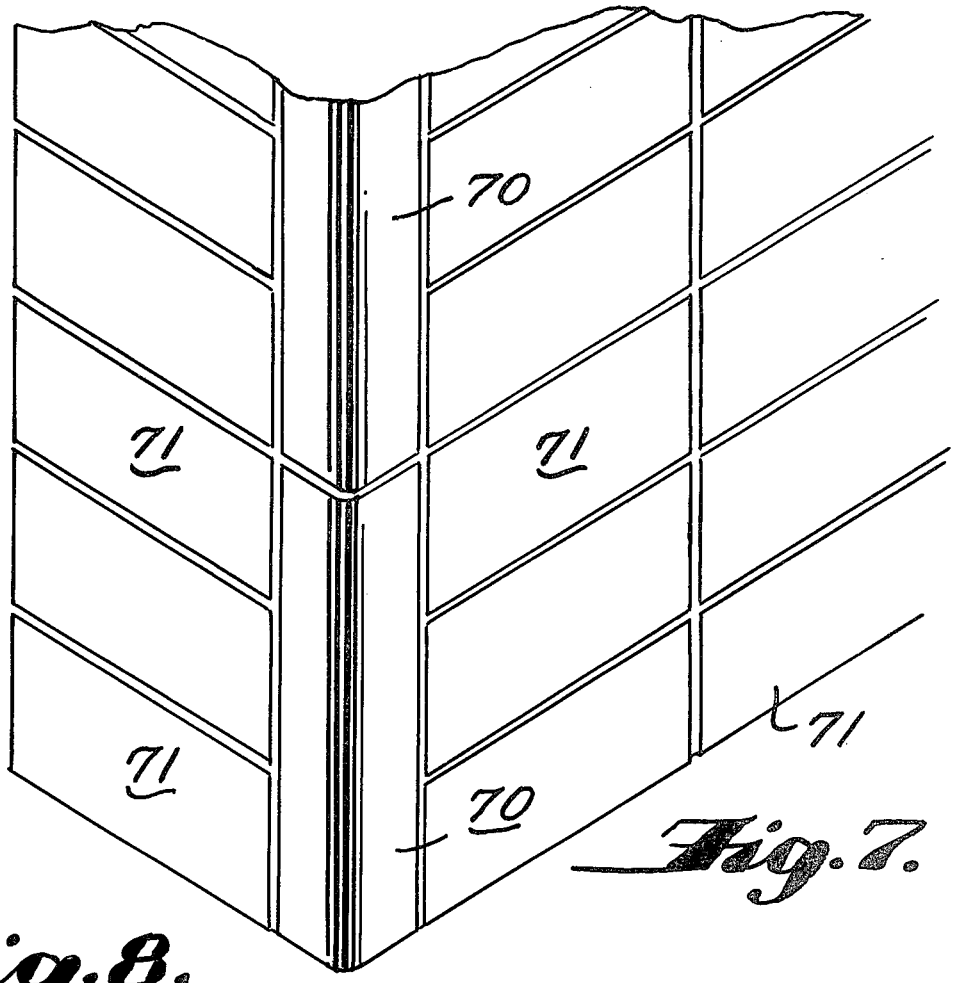
Fig. 7.
Fig. 8.
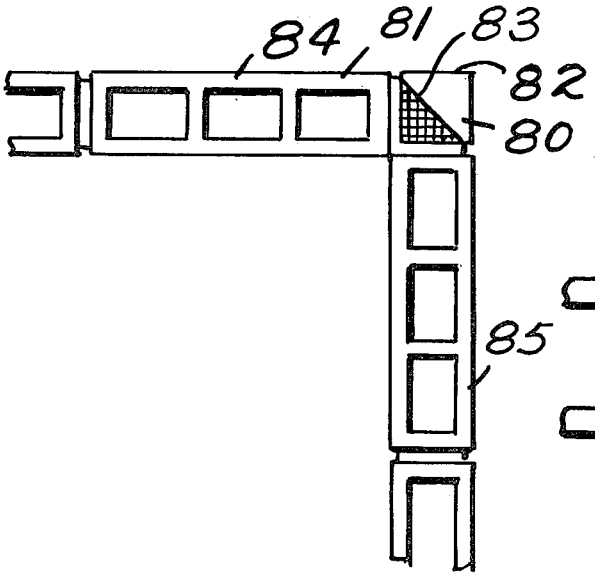
Fig. 9.
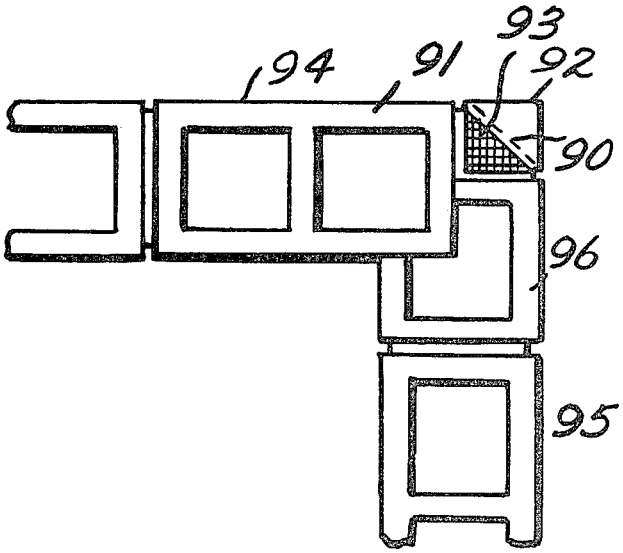

FILLED POLYMERIC WALL FACING UNITS AND SYSTEMS

BACKGROUND OF THE INVENTION

The present invention relates to filled polymeric wall facing units provided with at least one mortar tie-in member embedded in and protruding from the backing surface of these units, wall units of this type which are panels, wall units of this type which are corner units, and wall systems comprising these corner units.

Filled polymeric materials have been known to provide decorative and protective surfaces to walls. For instance, it has been known to coat masonry units filled with polyesters and form walls therefrom.

The basic patent on the use of polyester as coatings for masonry units is Sergovic U.S. Pat. No. 2,751,775.

In Sergovic, U.S. Pat. No. 3,328,231, a coated masonry building block was made of a cured composition of an unsaturated polyester resin and sand in which the sand comprises at least 50% by weight of the coating composition. The unsaturated polyester resin is derived from a reaction between a dicarboxylic acid, e.g., phthalic, maleic, furmaric, adipic, pimelic, suberic, itaconic, citraconic, succinic acids, hydrides and polyhydric alcohol, e.g., ethylene glycol, diethylene glycol and propylene glycol. There is also present an unsaturated monomer such as methyl methacrylate, styrene, diallyl phthalate, t-butyl styrene, alphamethyl styrene. In Sergovic, U.S. Pat. No. 4,031,289, coated masonry building blocks and articles and compositions therefor were provided which employed various pigments in combination with various resinous compositions to provide stain resistance to discoloration (blushing) when subjected to high moisture conditions for long periods. The entire disclosures of Sergovic U.S. Pat. Nos. 4,031,289; 3,328,231 and 2,751,775, are hereby incorporated by reference and relied upon.

Forming walls with coated masonry presents a particular problem with respect to the formation of the outside corners of the wall structures. For instance, coated cinder or concrete blocks must be coated on two sides in order for the coating material to show on two sides, thereby keeping uncoated block areas unexposed.

As an alternative to coating entire masonry units, it has been proposed to form integral molded facing layers on sections of masonry units which may, in turn, be incorporated into a base wall structure by means of a mortar binder. More particularly, it has been proposed to coat approximately 1 1/32 inch thick sections of cinder block or concrete material with about ⅛ inch of filled polyester in a manner analogous to that described above for coating entire masonry units. These coated sections of approximately 1 3/32 inch in depth and the same width and length of coated masonry blocks may be mortared onto a base wall structure, e.g., wall board, concrete block, or steel wall panels.

It is not possible to affix a polyester surface directly to a wall structure by means of mortar, because the polyester surface will not adhere sufficiently to a wall structure using mortar. Accordingly, there is a need to provide filled polymeric wall facing units, particularly corner units, capable of being incorporated into wall structures by means of mortar.

SUMMARY OF THE INVENTION

The present invention relates to a filled polymeric wall facing unit provided with at least one mortar tie-in member which is partially embedded in the polymeric matrix of the unit and which is partially protruding from the backing surface of the unit, thereby providing areas where mortar may adhere in spite of exposed polymeric surfaces on this backing surface. Preferably, the tie-in member is a foraminous wire screen.

Other aspects of this invention relate to particular wall facing units which are panels or corner units and wall systems comprising these corner units.

BRIEF DESCRIPTION OF THE DRAWINGS

FIG. 7 is a perspective view of a wall system having corner units according to the present invention.

FIG. 8 is a top plan view of a wall system having corner units according to the present invention.

FIG. 9 is a top plan view of a wall system having corner units according to the present invention wherein masonry units have been notched.

DETAILED DESCRIPTION

The present invention relates to wall facing units. The term wall facing unit is intended to connote a structure which may form an outer, visible surface on a wall. For example, wall facing units may provide a decorative and/or protective surface on a wall.

Wall facing units may be of two basic types, i.e. those which are self-supporting and those which are non-self-supporting. The aforementioned coated masonry units (e.g. those described in the Sergovic U.S. Pat. No. 2,751,775) represent examples of self-supporting wall facing units. In these units, a masonry block provides the support for the filled polymeric facing. The wall units of the present invention, however, are of the non-self-supporting variety. The wall units of the present invention rely on separately fabricated base wall structures for support. These base wall structures may be formed, for example, of materials such as wall board, concrete block and steel panels. It is also possible to support wall units, which are corner units, on base wall structures formed of coated masonry units. The wall facing units of the present invention are adapted to be tied into supporting base wall systems by means of mortar. Accordingly, the wall units of the present invention are provided with a mortar tie-in means on the backing surface thereof to accomplish this purpose.

Non-self-supporting wall facing units may be of a variety of types. The wall facing units of the present invention are preferably one of the following two types: (i) panels which are adapted to be supported by flat vertical wall surfaces; and (ii) corner units which are adapted to be supported by a base wall system at the outermost corner section of the base wall system at the juncture of two intersecting wall surfaces. Other wall facing units which are less preferred are those which are adapted to fit around door and window frames and those which are adapted to fit around the curved surfaces of curved base wall structures, e.g., the walls of a circular room.

Figure 1:
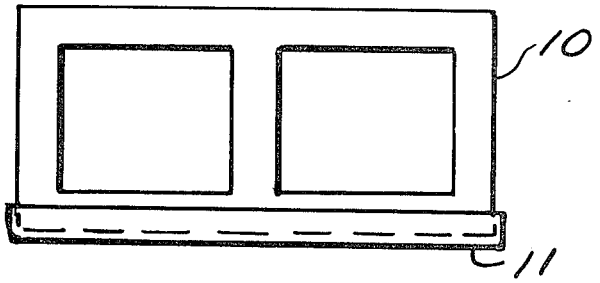
FIG. 1 is a top plan view of a coated masonry unit suitable for use in a wall system of the present invention comprising the corner wall facing units of the present invention.

Referring to FIG. 1, a top plan view of a coated masonry unit is shown where a masonry block 10 is coated with filled polymeric material 11. The polymeric material 11 thus forms an integral molded facing layer on the block 10. Such an integral molded facing layer may be formed by any method known in the art such as the method disclosed in the Sergovic U.S. Pat. No. 2,751,775.

Figure 2:
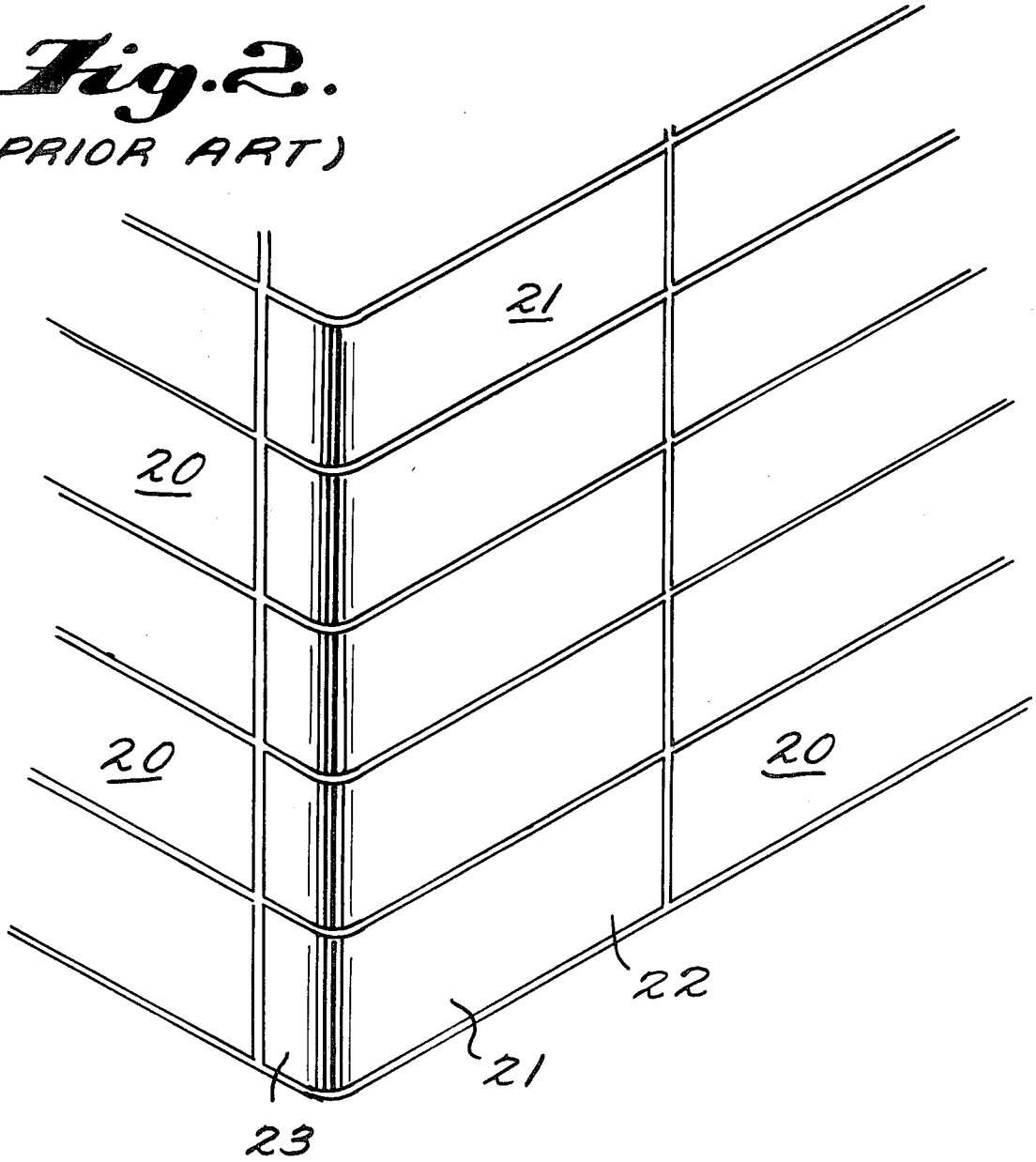
Fig. 2. (PRIOR ART)
FIG. 2 is a perspective view of a wall system having prior art coated masonry corner units.

Referring to FIG. 2, coated masonry units of FIG. 1, represented by coated masonry blocks 20 having a polymeric coating on one face only of the masonry block, are shown in a wall system. The corner units 21 of this wall system have polymeric coating on the two exposed faces of the masonry block. One of these faces 22 is the longer of the two exposed faces of the masonry block, while the other of these faces 23 is the shorter of the two faces. The coating on face 22 may be formed in a manner analogous to the coating of polymeric material 11 in FIG. 1. In other words, a masonry block may be inserted into a horizontal mold containing a filled resin and the resin cured in situ to form the coating of polymeric material 11. However, it is extremely difficult to form the coating on face 23 in such a molding process, because the filled resin must be applied to more than one side of the block requiring simultaneous application to the vertical as well as the horizontal geometric planes. Consequently, the cost of making such coated masonry units having a coating of two or more faces of the block is considerably higher than the cost of making masonry units having such a coating on only one face thereof.

Figure 3:
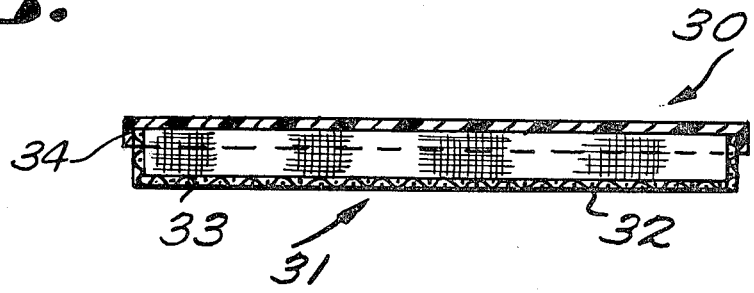
FIG. 3 is a horizontal sectional view through a panel to illustrate how a metal mesh is embedded into the panel.

An alternative to the wall system of FIG. 2 is provided by means of the filled polymeric wall facing unit shown in FIG. 3. Referring to FIG. 3, the wall facing unit has a facing side 30 and a backing side 31. The backing side 31 is provided with a metal mesh tie-in member 32. This metal mesh tie-in member is partially embedded in the backing side 31 of the facing unit, while the non-embedded portion 33 protrudes from the backing side 31. The degree to which the tie-in member 32 is embedded into the facing unit should be sufficient to provide enough of the embedded member portion 34 to effectively anchor the tie-in member into the polymeric matrix of the facing unit. Also, enough of the non-embedded tie-in member 33 should protrude to provide a surface capable of effectively adhering the facing unit to a wall by means of mortar.

Although the tie-in member of FIG. 3 is shown as a metal mesh member, it will be understood that less preferably other tie-in members may also be used, although the use of metal mesh is preferred. Accordingly, a strapping material such as steel strap or glass cloth strap may be used. When such a strapping material is used, it is desirable to use a plurality of such straps so that the straps protrude from a plurality of locations along the backing surface of the facing unit.

The shape of the metal mesh tie-in member 32 may take any convenient form, but is preferably in the form of a rectangular shaped box. More particularly, a metal mesh lathing sheet may be folded into an open box shape having roughly the same length and width of the facing unit and a depth of, for example, from about $\frac{1}{2}$ to about $1\frac{1}{2}$ inches. Accordingly, when such a box shaped metal mesh structure is used the thickness of the filled polymeric material of the facing unit may be, for example, from about $\frac{1}{4}$ inch to about 182 inch and the depth to which the open face of the metal mesh box (i.e., that face which does not contain metal mesh) may be embedded into this polymeric material, may be, for example, from about $\frac{1}{8}$ inch to about $\frac{1}{2}$ inch. The length and width of the facing unit may be according to standard sizes such as $15\frac{3}{4}$ inches or $17\frac{1}{8}$ inches in length and $3\frac{7}{8}$ inches, $5\frac{7}{8}$ inches or $7\frac{7}{8}$ inches in width. It is also possible to form even longer pieces of backed material which may be later cut with a mason saw to the desired length.

Figure 4A:
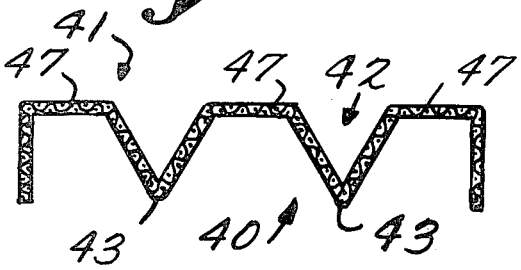
FIGS. 4*a*, 4*b* and 4*c* are side plan views of metal mesh mortar tie-in members of various configurations adapted for use in panels.
Figure 4B:
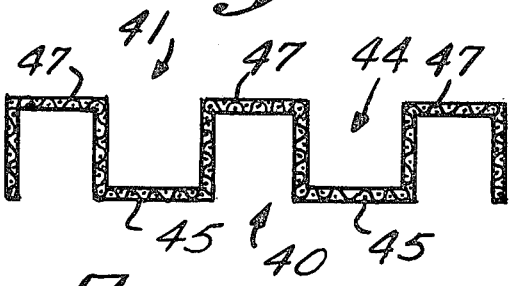
Figure 4C:
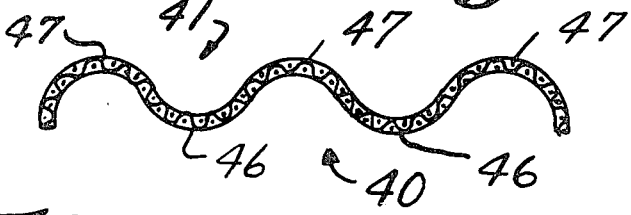

FIGS. 4*a*, 4*b* and 4*c* show various alternative configurations of metal mesh tie-in members for panels. More particularly, these metal mesh tie-in members are sheet materials which are adapted to be embedded into the surface of the panel along side 40, thereby presenting a uniform mortar tie-in surface protruding from the panel along side 41. Thus, FIG. 4*a* shows a metal mesh sheet material which has been bent in several places in a triangular fashion 42 to provide surfaces 43 to be embedded into the panel. FIG. 4*b* shows a metal mesh sheet which has been bent in several places in a square or rectangular fashion 44 in order to provide surfaces 45 which can be embedded into the panel. FIG. 4*c* shows a metal mesh sheet which has been bent in a repeating sinusoidal pattern to provide surfaces 46 which can be embedded into the panel. Referring to each of FIGS. 4*a*, 4*b* and 4*c*, after the wire mesh is embedded into the panel, the points of the mesh surface 47, which protrude furthest from the panel, should define a plane which is substantially parallel with the facing surface of the panel so that panels can be adhered in substantially parallel fashion to the base wall structure with the mortar binder. In the case of both the panel and the corner unit, removable rectilinear or spherical shaped rods can be placed across the top of the mold or a similar supporting system may be used to assure that the furthest protruding points of mesh or tie-in system form parallel planes to the plane of the decorative surface of the wall facing unit.

Particulate matter of relatively large particle size (e.g., $\frac{1}{4}$–$\frac{3}{4}$ inch in mesh size or mean particle diameter) may be used as tie-in members. This particulate matter may comprise gravel or crushed pieces of cinder block or concrete. Metal objects such as bolts or barbs may further be used as tie-in members.

By use of these tie-in members it is possible to produce facing units which are quite distinguishable from wall units having an integral molded facing layer on a masonry unit or a relatively thin section of such a masonry material. For one thing, the tie-in members of the present invention provide a means whereby a mononlithic cast object of filled polymeric material may be formed and incorporated into a wall system. The coated masonry materials are contrasted from such objects in that they are not monolithic. Also, the filled polymeric material constitutes the major constituent in terms of weight percent of the facing unit having tie-in members, whereas the masonry material constitutes the major constituent of an integral molded masonry unit.

Moreover, whereas in coated masonry material lips of polymeric material displaced by the weight of the masonry material are often raised above the level of the interface of the masonry material on the backing side of the units of the present invention, whereby the surface of polymeric material along the backing side of the unit remains substantially flat, except for minor irregularities, e.g., formed by the evolution of gas bubbles during the curing process.

Another distinction between these wall components is that the filled polymeric portion of the facing unit containing the tie-in member is generally thicker (e.g., at least $\frac{1}{4}$ inch thick), than the filled polymeric portion of the integral molded masonry unit (e.g., no more than $\frac{1}{8}$ inch). A further distinction is that the tie-in members, being either foraminous or a plurality of relatively small objects, may leave areas of filled polymeric material exposed or visible along the backing surface of the facing unit, whereas the backing surface of the integral molded unit is substantially covered by masonry material.

The wall facing unit of FIG. 3 may be formed by a molding process. More particularly, a filled resin may be poured into a mold to the desired thickness. It is possible to partially prepolymerize this resin at this stage in order to thicken the resin so that it will support the weight of the tie-in member. However, in the case of sand filled polyester resins of sufficient viscosity it is possible to place the tie-in member or members directly into the resinous material. The resinous material may then be cured thereby incorporating filler and the embedded portions of tie-in member(s) into the polymeric matrix. Thus, the lowermost surface of the filled resin, which contacted the bottom of the mold, becomes the facing surface of the wall unit, whereas the open surface of the filled resin to which the tie-in member(s) has been added becomes the backing surface of the wall unit. Accordingly, a contoured mold may be used to form wall facing units having a contoured facing surface.

Figure 5:
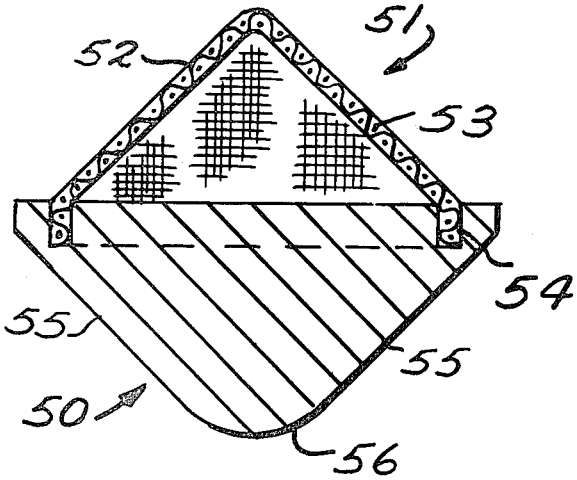
FIG. 5 is a horizontal sectional view through a corner unit to illustrate how a metal mesh is embedded into the corner unit.

Such a contoured mold may be used to form the corner wall facing unit shown in FIG. 5. The features of this corner wall facing unit of FIG. 5 are analogous to the features of the wall facing unit of FIG. 3. Thus, the corner wall facing unit of FIG. 5 has a facing side 50 and a backing side 51. The backing side 51 is provided with a metal mesh tie-in member 52 having a protruding portion 53 and an embedded portion 54.

The facing surface 50 of FIG. 5 conforms to the shape of the mold in which it is made. Thus, the facing surface of FIG. 5 is basically an angled surface having flat surfaces 55 and curved surface 56. This curved surface is of architectural significance in that it does not present a sharp surface for one to bump against. However, it will be understood that the facing surface of such a corner facing unit may be completely angled or completely curved, as well as being the hybrid angled/-curved surface of FIG. 5. Also, although the curvature or angle of this surface in FIG. 5 is 90°, it will be understood that other degrees of angles or curvature are possible depending upon the angle presented by the walls intersecting at the corner of the wall system which includes the corner unit.

The metal mesh tie-in member 52 of FIG. 5 is shown to have an isosceles triangular cross-section. The base of this elongated triangular member conforms roughly to but is sightly smaller than the length and width of the backing surface 51 of the facing unit. The height of this triangular section is roughly equally to the depth of the filled polymeric material. Thus, the shape of the corner unit, including the metal mesh tie-in member is roughly square in cross-section. This square shape facilitates the incorporation of the corner facing unit into a wall system as will be described hereinafter. Optionally, the angle at the apex of the triangular cross-section of the metal mesh member may be greater than 90° to permit more mortar to be placed behind the unit.

Figure 6:
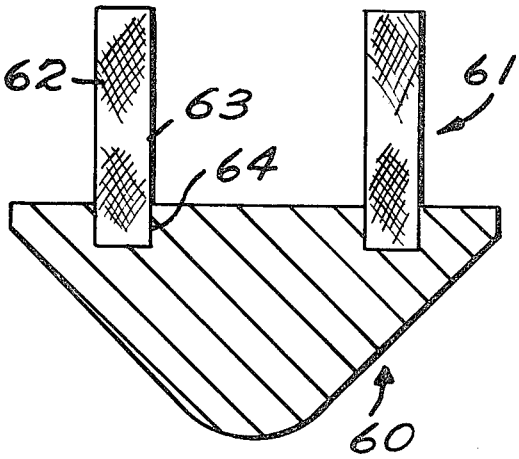
FIG. 6 is a horizontal sectional view through a corner unit to illustrate how strapping material is embedded into the corner unit.

FIG. 6 shows a corner wall facing unit which corresponds to the corner wall facing unit of FIG. 5, except that the metal mesh tie-in member 52 of FIG. 5 is replaced by strapping tie-in members 62 in FIG. 6. Thus, the corner wall facing unit of FIG. 6 has a facing side 60 and a backing side 61. The backing side 61 is provided with metal mesh tie-in members 62 having protruding portion 63 and embedded portion 64.

FIG. 7 shows a wall system having corner units as shown in FIGS. 5 or 6. These corner units 70, thus, are placed in the corner section of the wall system. The walls of this system are formed of wall units 71, which correspond to the coated masonry units shown in FIG. 1.

FIG. 8 shows an overhead, cutaway view of a wall system shown in FIG. 7. Thus, corner unit 80 corresponds to corner units 70 of FIG. 7, and wall units 81 correspond to wall units of 71 of FIG. 7. The corner units 80 have a facing surface 82 and a metal mesh tie-in member 83. Also, the wall units 81 have an integral molded filled polymeric facing 84 which is molded onto masonry units 85.

FIG. 9 shows a wall system similar to that of FIG. 8 except that one of the wall units 96 has been notched to fit the corner unit 90. The wall system of FIG. 8 further comprises wall units 91, corner unit facing surface 92, metal mesh tie-in member 93, integral molded filled polymeric facing 94 and masonry units 95.

The polymeric composition used to form the wall facing unit of the present invention is preferably a polyester composition, more particularly, unsaturated polymerizable polyester resins. However, less preferred polymeric compositions include those derived from epoxy resins and urethane resins. Such less preferred epoxy and urethane resins are described in the McClinton, U.S. Pat. No. 4,031,282, the entire disclosure of which is incorporated herein by reference and relied upon.

These polymeric compositions are filled with a reinforcing amount (e.g., 10% by weight or more based on the weight of the resin) of a suitable filler material. The filler is preferably sand but other granular mineral filler can be employed such as gravel, flint, granular calcium carbonate, e.g., marble. Small amounts of pigments can be added to give any desired color to the final product. The granular filler can have a mesh size from 20 to 325 mesh, preferably 20 to 140 mesh. The filler should not be powdered. Preferably, the filler constitutes at least 50% weight of the filled polymeric composition.

FIGS. 7, 8 and 9 also serve to illustrate the manner in which corner units may be dimensioned in order to be incorporated into wall systems. Coated masonry blocks most commonly have standard thickness of, e.g., 4, 6 and 8 inches. Taking into account the provision of a mortar spacing, corner units may thus be, e.g., $3\frac{3}{4}\times3\frac{3}{4}$ inches, $5\frac{3}{4}\times5\frac{3}{4}$ inches or $7\frac{3}{4}\times7\frac{3}{4}$ inches. Accordingly, FIG. 8 shows the manner in which, e.g., a $3\frac{3}{4}\times3\frac{3}{4}$ inches corner unit may be incorporated into a wall system having 4 inch thick coated masonry blocks, whereas FIG. 9 shows the manner in which, e.g., a $3\frac{3}{4}\times3\frac{3}{4}$ inches corner unit may be incorporated into a wall system having a 8 inch thick coated masonry block.

As shown in FIG. 7 the corner units may have a length corresponding to the height of one or more coated masonry blocks. This length of the corner unit may be an as-cast length or it may be obtained by cutting (e.g., with a masonry saw) an elongated casting of the corner unit.

Suitable unsaturated polymerizable polyester resins which may be used as compositions for the wall units of the present invention may be obtained from reacting a dicarboxylic acid with a polyhydric alcohol in a manner that is familiar to resin chemists. Thus there can be used any of the unsaturated polymerizable polyester resins of the above mentioned Sergovic, U.S. Pat. Nos. 4,031,289; 2,751,775 and 3,328,231. Preferred resinous compositions have a polyester made from a glycol component consisting of neopentyl glycol or a mixture of neopentyl glycol, with up to 42 molar percent based on the total glycol of a glycol selected from a group consisting of propylene glycol, ethylene glycol and diethylene glycol and a dicarboxylic acid component consisting of isophthalic acid and maleic anhydride, the maleic anhydride being 10 to 33 percent of the total poylester resin by weight. There is also included either styrene and/or methyl methacrylate. The preferred unsaturated polymerizable polyester resin formulation employed in the present invention consist of isophthalic acid, maleic anhydride and neopentyl glycol or a propylene glycol resin which is high in isophthalic acid content which polyester is present together with the polymerizable monomers styrene and methyl methacrylate.

Those polyester resins which can be used are ethylenically unsaturated alkyl resins. Among the dicarboxylic acids which may be used are phthalic, malic, maleic, fumaric, adipic, pimelic, suberic, sebacic, itaconic, citraconic, and succinic acids and their anhydrides. It is essential that some of the dicarboxylic acid component of the polyester resin contain an unsaturated ethylenic linkage. For this reason, maleic and fumaric acids are most desirable. Among the polyhydric alcohols which may be used are ethylene glycol, diethylene glycol, propylene glycol and neopentyl glycol. A mixture of propylene glycol and dipropylene glycol is the most satisfactory polyhydric alcohol. One may use an unsaturated monohydric alcohol in place of part of the polyhydric alcohol. A typical example of such an alcohol is allyl alcohol which produce an allyl ester of the dicarboxylic.

The mole ratio of total alcohol to total acid is approximately the theoretical one of 1:1. Preferably, a slight excess of glycol, e.g., 2% molar excess, is employed.

As is conventional in making unsaturated polyesters, they are cut with polymerizable solvents in an amount sufficient to make the uncured composition liquid when applied to the mold for forming the wall unit. There can be employed, for example, 30 to 45%, or even up to 55%, of the polymerizable solvent. The preferred polymerizable solvents as indicated are styrene, methyl methacrylate and mixtures thereof. However, there can be used other polymerizable solvents such as those mentioned in prior U.S. Pat. Nos. 2,751,775 and 3,328,231, e.g., p-methyl styrene, vinyl acetate, diallyl phthalate, cyclopentadiene, ethyl acrylate.

The precoating of the silicous particles, e.g., sand particles, is achieved through employing an ethylenically-unsaturated organofunctional silane, e.g., those set forth in the aforementioned Sergovic, U.S. Pat. Nos. 4,031,289 and 3,328,231. Thus there can be used silanes or siloxanes having the general formula:

$$R_xSiX_{(4-x)}$$

in which at least one R is an unsaturated group, preferably an unsaturated hydrocarbon group, e.g., an alkenyl, haloalkenyl or alkadienyl group, including dienyl, vinyl, chlorvinyl, bivinyl, allyl, methallyl, chlorallyl, and the like; X is a group which reacts with the hydroxyl groups present in sand or moisture normally present in the surface of and such as, preferably, chlorine or bromine, although it may be oxyaryl, oxyalkyl, amino, etc.; x is a whole number from 1 to 3. If more than one R group is present, the remaining R groups can be hydrocarbyl, e.g., alkyl, such as methyl or ethyl or aryl, e.g., phenyl. Examples of these compounds are allyl triethoxy silane
diallyl diethoxy silane
triallyl ethoxy silane
methallyl trichloro silane
trichloroallyl chloro silane
allylphenyl dichloro silane
allylphenyl dichloro silane
allylmethyl diethoxy silane
diallylmethyl ethoxy silane
allyl trichloro silane
dimethallyl diethoxy silane
vinyl trichloro silane
divinyl dichloro silane
trivinyl monochloro silane
vinyl triethoxy silane
methyl vinyl dichloro silane These organofunctional silanes are preferably selected from the group consisting of vinyltriethoxysilane, vinyl-tris(2-methoxyethoxy)-silane and gamma-methacryloxy-propyltrimethoxy silane. Filler particles having a Tyler screen size of from about 4 mesh to 200 mesh may be treated with about 0.001 percent to about 1.25 percent by weight with the unsaturated organofunctional silane. The preferred treatment of the particles and granules is with about 0.5 percent by weight with vinyl-tris(2-methoxyethoxy)silane.

The preferred resin composition including the polymerizable solvent and catalyst is shown in Table 1.

TABLE I

| | |
|---|---|
| Composition A - Resin Formulation A | |
| Isophthalic Maleic neopentyl glycol | 800 g |
| Vinyl Benzene | 100 g |
| Methyl Methacrylate | 320 g |
| Tri-ethyl Phosphate | 150 g |
| Bentone - 38 of National Lead, Inc. | 7.5 g |
| A-benzotriazole-Sold under the tradename Cyasorb-5411 American Cyanamid | 2.7 g |
| Dow Corning Anti-Foam A-A modified methyl silicone fluid | 2 g |
| Alumina trihydrate ($Al_2O_3 \cdot 3H_2O$) | 50 g |
| Catalyst Component B | |
| Peroxyester 2.5-dimethyl 2.5-bix (2-ethyl hexanoylperoxy) hexane liquid | 12.5 g |

It will be recognized by those skilled in the art that the resin component A may be modified by the omission or substitution by other materials and various components such as, the tri-ethyl phosphate which is a compound employed in the resin composition to impart flame retardancy to the polyester composition. Alternatively various chlorinated paraffin compounds may be substituted to impart flame retardancy to the composition. Similarly, in certain applications the Bentone 38 which is a rheological additive that is an organic derivative of magnesium montmorrillonite sold by National Lead, Inc., may be added or other additives substituted in the composition. In a similar manner, the A-benzotriazole may be substituted with other UV agents or may be omitted where UV resistance is not particularly important. It will be further recognized by those skilled in the art that the anti-foaming compound and the alumina trihydrate ($Al_2O_3H_2O$) may be similarly deleted or other compounds substituted in their place.

Conventional free radical catalysts, e.g., peroxygen compounds, can be employed as curing agents for the unsaturated polyester resin, e.g., benzoyl peroxide, methyl ethyl ketone peroxide, T-butyl perbenzoate, t-butylperoctoate, and 2,5-dimethyl-2,5-bis(2-ethylhexanoylperoxy)hexane (available as U.S. Peroxygen Catalyst 245). The amount of catalyst is not critical and as is conventional is usually between 0.5 and 2% of the total weight of the unsaturated polyester and polymerizable solvent. In the preferred embodiment 12.5 grams of U.S. Peroxygen Catalyst 245 will cure the resinous compositions in about 20 minutes at about 370° F. plate temperature.

Accordingly, cast articles of the present invention and also coated masonry units and blocks may be particularly suited for exterior purposes such as the exterior walls of building and structures which are constantly exposed to sunlight and ultraviolet light which would otherwise degrade the pigmentation of tiles and other articles.

Unless otherwise indicated, all parts and percentages are by weight.

In order to more clearly disclose the nature of the present invention, specific examples are set forth hereinafter:

Three basic materials are prepared:

a. Sand Mixture
b. Polyester Resin
c. Pigmented Compound as will be described below:

EXAMPLE I

A surface-treated sand mixture is first prepared by mixing: 200 lbs.—Silica Sand (approximate sieve analysis)

30% on No. 70 Mesh U.S. Sieve
40% on No. 100 Mesh U.S. Sieve
20% on No. 140 Mesh U.S. Sieve
10% through No. 140 mesh U.S. Sieve 800 lbs.—Silica Sand (approximate U.S. Sieve analysis)—
5% on No. 30 Mesh U.S. Sieve
75% on No. 40 Mesh U.S. Sieve
20% on No. 50 Mesh U.S. Sieve To this sand mixture is added 0.05% by weight of vinyl-tris (2-methoxyethoxy) silane $CH_2{=}CH\ Si\ (OC_2H_4OCH_3)_3$. After thorough blending, the mass is heated to 150° F. to effect hydrolysis of the silane. This surface-treated sand will be referred to as Sand Blend No. 1.

An unsaturated polyester resin is made by heating in appropriate resin-making apparatus a mixture of:

| Ingredient | Mols | Molecular Weight | Pounds per Batch |
|---|---|---|---|
| Neopentyl Glycol | 1.02 | 104 | 106.0 |
| Isophthalic Acid | 0.05 | 166 | 83.0 |
| Maleic Anhydride | 0.5 | 98 | 49.0 |
| | | | 238.0 |

The resultant resin has a maleic anhydride content of 23.2% and acid value of 20 (based on solid resin). It is reduced with styrene to make a resin solution containing 55% polyester resin and 45% styrene. This resin solution will be referred to as Resin "A".

A pigmented Compound No. 1 is prepared from Resin "A" according to the following:

| Ingredient | Amount |
|---|---|
| Resin A | 760 |
| Styrene | 38 |
| Chlorinated Paraffin (70% Chlorine) | 28 |
| National Lead Oncor 75 (25% Antimony Trioxide - 75% $SiO_2$) | 15 |
| Dow Anti Foam A (a silicone anti-foaming agent) | 2 |
| Titanium Dioxide | 12 |
| Asbestine | 145 |

by thoroughly mixing the above ingredients in a paint-making blender.

From the previously-prepared materials, a composition is prepared as follows:

| Ingredients | Amount |
|---|---|
| Pigmented Compound No. 1 | 710 lbs. |
| Methyl methacrylate | 248 |
| Triethyl Phosphate | 106 |
| U.S. Peroxygen Catalyst No. 245 | 8 |
| Aluminum Trihydrate | 144 |
| Sand Blend No. 1 | 3260 |

After thorough mixing, the composition is placed into a mold and distributed to a uniform thickness of approximately $\frac{5}{8}$ inch. An open box-shaped metal mesh lathing material is embedded, open face down, into the composition. The thicknes of this box is approximately $\frac{3}{4}$ inch and the depth to which the mesh is embedded into the composition is approximately 9/32 inch. The mold, with the composition and metal mesh, is then placed in a curing oven, wherein the temperature of the composition is raised from 260° to 300° F. in 15 minutes to effect cure of the facing unit. The curing causes the facing to become solid, thereby firmly anchoring the metal mesh in the backing surface of the facing unit. The cured composition is then removed from the mold and has a smooth decorative facing having excellent resistance both to staining and discoloration (blushing) due to moisture. The facing unit is a panel structure corresponding to that shown in FIG. 3 and having a uniform overall thickness of approximately 1 3/32 inch from the facing surface to the protruding surface of metal mesh on the backing side.

EXAMPLE II

A composition is prepared as in Example I and, after thorough mixing is placed into a triangular-shaped mold and is distributed uniformly throughout the mold. A triangular-shaped metal mesh lathing material having an open base is embedded, open face down, into the composition. The mold, with the composition and metal mesh, is then placed in a curing oven, wherein the temperature of the composition is raised from 260° to 300° F. in 15 minutes to effect cure of the facing unit. The curing causes the facing to become solid, thereby firmly anchoring the metal mesh in the backing surface of the facing unit. The cured composition is then removed from the mold and has a smooth decorative facing having excellent resistance both to staining and discoloration (blushing) due to moisture. The facing unit is a corner structure corresponding to that shown in FIG. 5.

EXAMPLE III

An unsaturated polyester resin is made by heating in an appropriate resin-making apparatus a mixture of:

| Ingredient | Mols | Molecular Weight | Pounds per Batch |
|---|---|---|---|
| Propylene glycol | 0.46 | 76 | 39.96 |
| Neopentyl glycol | 0.64 | 101 | 66.67 |
| Isophthalic acid | 0.33 | 166 | 54.78 |
| Maleic Anhydride | 0.67 | 98 | 65.66 |
| | | | 221.96 |

The resultant resin has a maleic anhydride content of 33.0% and an acid value of 16 (based on solid resin). It is reduced with styrene to make resin solution containing 55% polyester resin and 45% styrene. This resin solution will be referred to as Resin "B".

From the previously-prepared materials, a pigment Compound No. 2 is prepared as follows:

| Ingredients | Amount |
|---|---|
| Resin B | 760 |
| Styrene | 38 |
| Chlorinated Paraffin (70% Chlorine) | 28 |
| National Lead Oncor 75 (25% Antimony Troxide - 75% $SiO_2$) | 15 |
| Dow Anti Foam A | 2 |
| Titanium Dioxide | 12 |
| Asbestine | 145 |

by thoroughly mixing the above ingredients in a paint-making blender.

From the previously-prepared materials, a composition is prepared as follows:

| Ingredients | Amount |
|---|---|
| Pigmented Compound No. 2 | 710 lbs. |
| Methyl Methacrylate | 248 |
| Triethyl Phosphate | 106 |
| U.S. Peroxygen Catalyst No. 245 | 8 |
| Aluminum Trihydrate | 144 |
| Sand Blend No. 1 | 3260 |

Following the exposure described in Example I, a panel is produced which is resistant to staining and discoloration (blushing) due to moisture.

EXAMPLE IV

A composition is prepared as in Example III and following the exposure described in Example II a corner unit is produced which is resistent to staining and discoloration (blushing) due to moisture.

The terms and expressions which have been employed are used as terms of description and not limitation, and it is not intended in the use of such terms and expressions, of excluding any equivalents of the features shown and described or portions thereof, but it is recognized that various modifications are possible within the scope of the invention claimed. The present invention may comprise, consist essentially of or consist of the method steps or materials recited herein.

What is claimed is:

1. A wall system having a facing of filled polymeric material, comprising:

(I) walls comprising masonry block having an integral molded facing layer of said filled polymeric material; and (II) at least one corner comprising corner units comprising:

(a) a curved or angled facing surface; and (b) a backing surface which is adapted to be incorporated into said corner of said wall system, said corner units comprising:

(i) said filled polymeric material; and (ii) at least one mortar tie-in member, wherein said backing surface (b) has exposed areas of said cured polymeric matrix material and protruding therefrom said at least one mortar tie-in member, said tie-in member being partially embedded in said filled polymeric material.

2. A wall facing system unit according to claim 1 wherein said facing unit comprises a cured resinous composition of an ethylenically-unsaturated polymerizable polyester resin and sand particles, said sand particles comprising at least about 50% by weight of said composition, and in which said sand particles and cured resin are bonded to one another by a bonding agent comprising an unsaturated silane also having attached to the silicon a group which reacts with the hydroxyl groups present in sand or moisture present in the surface of sand.

3. A wall system according to claim 1 wherein said filled polymeric material comprises a cured resinous composition of an ethylenically-unsaturated polymerizable polyester resin and sand particles, said sand particles comprising at least about 50% by weight of said composition.

4. A wall facing unit according to claims 1 or 3, wherein said tie-in member is a metal mesh lathing material.

5. A wall facing unit according to claim 1 or 3 wherein said tie-in member comprises a strapping material.

6. A wall facing unit which is a panel unit having:

(a) a decorative facing surface; and (b) a backing surface which is adapted to be incorporated into a supporting flat, vertical base wall system by means of mortar, said panel unit comprising:

(i) reinforcing filler;

(ii) cured polymeric matrix material, having a uniform thickness of about $\frac{1}{4}$ inch to about $\frac{3}{4}$ inch; and (iii) at least one mortar tie-in member, wherein said backing surface (b) has relatively flat, exposed areas of said cured polymeric matrix material and protruding therefrom at least one mortar tie-in member, said member being an open faced metal mesh box partially embedded open face down from about $\frac{1}{8}$ inch to about $\frac{1}{2}$ inch into said cured polymeric matrix material, the overall depth of said open face metal mesh box being from about $\frac{1}{2}$ inch to about $1\frac{1}{2}$ inches.

7. A panel facing unit according to claim 6 wherein said facing unit comprises a cured resinous composition of an ethylenically-unsaturated polymerizable polyester resin and sand particles, said sand particles comprising at least about 50% by weight of said composition.

8. A panel facing unit according to claim 6 which is approximately 1 3/32 inch in thickness from the facing surface to the protruding surface of the metal mesh on the backing side.

9. A wall facing unit which is a corner unit having;

(a) a curved or angled facing surface; and (b) a backing surface which is adapted to be incorporated into the corner of a vertical wall system by means of mortar, said corner facing unit comprising:

(i) reinforcing filler;

(ii) cured polyermic matrix material, and (iii) at least one metal mesh mortar tie-in member, wherein said backing surface (b) has relatively flat, exposed areas of said cured polymeric matrix material extending therefrom normal to the plane of the facing unit at least one metal mesh mortar tie-in member, said member being partially embedded in said cured polymeric matrix material, being triangular in cross section.

10. A corner wall facing unit according to claim 9 wherein said facing unit comprises a cured resinous composition of an ethylenically-unsaturated polymerizable polyester resin and sand particles, said sand particles comprising at least about 50% by weight of said composition.

11. A corner facing unit according to claim 9 wherein said mortar tie-in member is an isosceles triangular shaped metal mesh, the base section of said triangular shaped member being embedded in said polymeric matrix material and the apex of said triangular shaped member extending out from said polymeric matrix material, said apex defining an angle of 90° or more.

12. A corner facing unit according to claim 11, wherein the shape of the corner unit including the metal mesh is roughly square in cross-section and has the dimensions of about $3\frac{3}{4}$ inches by $3\frac{3}{4}$ inches.

13. A wall facing claim according to claim 9 wherein said facing unit comprises a cured resinous composition of an ethylenically-unsaturated polymerizable polyester resin and sand particles, said sand particles comprising at least about 50% by weight of said composition, and in which said sand particles and cured resin are bonded to one another by a bonding agent comprising an unsaturated silane also having attached to the silicon a group which reacts with the hydroxyl groups present in sand or moisture present in the surface of sand.

14. A wall facing unit having:

(a) a facing surface; and (b) a backing surface through which said facing unit is adapted to be incorporated into a supporting base wall by means of mortar, said facing unit comprising:

(i) reinforcing filler;

(ii) cured polymeric matrix material, (iii) at least one mortar tie-in member, wherein said backing surface (b) has exposed areas of said cured polymeric matrix material and protruding therefrom said at least one mortar tie-in member, said tie-in member being partially embedded in said cured polymeric matrix material, and being of metal mesh of rectangular shape extending roughly the same length and width of the facing unit.

15. A wall facing unit according to claim 14 which is a panel unit.

16. A wall system comprising a plurality of the panels of claim 15 as an integral molding facing layer for walls comprising masonry blocks.

17. A wall facing unit according to claim 14 wherein said facing unit comprises a cured resinous composition of an ethylenically-unsaturated polymerizable polyester resin and sand particles, said sand particles comprising at least about 50% by weight of said composition, and in which said sand particles and cured resin are bonded to one another by a bonding agent comprising an unsaturated silane also having attached to the silicon a group which reacts with the hydroxyl groups present in sand or moisture present in the surface of sand.

18. A panel facing unit according to claim 14 wherein said facing unit comprises a cured resinous composition of an ethylenically-unsaturated polymerizable polyester resin and sand particles, said sand particles comprising at least about 50% by weight of said composition.

19. A wall facing unit having:

(a) a facing surface; and (b) a backing surface through which said facing unit is adapted to be incorporated into a supporting base wall by means of mortar, said facing unit comprising:

(i) reinforcing filler;

(ii) cured polymeric matrix material (iii) at least one mortar tie-in-member, wherein said backing surface (b) has exposed areas of said cured polymeric matrix material and protruding therefrom said at least one mortar tie-in-member, said tie-in-member being partially embedded in said cured polymeric matrix material, and being of metal mesh of rectangular shape and of lesser length and width than the length and width of the facing unit.

* * * * *